United States Patent [19]

Punako et al.

[11] 4,447,110

[45] May 8, 1984

[54] SOCKET CONTACT FOR AN ELECTRICAL CONNECTOR

[75] Inventors: Stephen Punako, Bainbridge; Alan L. Davis, Unadilla, both of N.Y.; Raymond J. Eifler, Farmington Hills, Mich.

[73] Assignee: The Bendix Corporation, Southfield, Mich.

[21] Appl. No.: 368,594

[22] Filed: Apr. 15, 1982

[51] Int. Cl.[3] ..... H01R 11/22

[52] U.S. Cl. ..... 339/262 RR; 339/262 R

[58] Field of Search ..... 339/258 R, 258 P, 262 R, 339/258 RR, 276 T, 278 T, 276 R, 142, 262 RR

[56] References Cited

U.S. PATENT DOCUMENTS

| | | | |
|---|---|---|---|
| 465,430 | 12/1891 | Desant | 339/262 R |
| 2,185,193 | 1/1940 | Hanson | 339/262 R X |
| 3,023,396 | 2/1962 | Swanson | 339/258 |
| 3,286,222 | 11/1966 | Drinkwater | 339/258 |
| 3,350,680 | 10/1967 | Benoit et al. | 339/262 R X |
| 3,564,487 | 2/1971 | Upstone | 339/258 |
| 3,654,595 | 4/1972 | Curr | 339/262 R X |
| 4,072,392 | 2/1978 | McConnell et al. | 339/258 R |
| 4,120,556 | 10/1978 | Waldron et al. | 339/142 |
| 4,278,317 | 7/1981 | Gallusser et al. | 339/258 R |

FOREIGN PATENT DOCUMENTS

| | | | |
|---|---|---|---|
| 564784 | 1/1924 | France | 339/262 R |

*Primary Examiner*—William R. Briggs

*Attorney, Agent, or Firm*—R. J. Eifler; C. D. Lacina

[57] ABSTRACT

A three-piece socket contact characterized by a solid machined contact body (10), a tubular spring member (20) having at least one radially inwardly extending detent that engages a groove (11) in the contact body (10) to secure the spring member (20) to the contact body (10), and a protective sleeve (30) telescopically mounted over the tubular spring member (20).

4 Claims, 5 Drawing Figures

SOCKET CONTACT FOR AN ELECTRICAL CONNECTOR

This invention relates to electrical connectors and more particularly to an electrical contact mounted within the connector.

Electrical connectors generally include a plug and receptacle, each of which has an insert of dielectric material provided with multiple openings within which electrical contacts are retained. The insert is introduced from the rearward end of the metallic metal shell where it is held in place by some means, such as a nut. Some connectors provide for rearward insertion and front or rear release of the electrical contacts. While other connectors provide for front insertion and front or rear release of the electrical contacts. These features are desirable as they facilitate the assembly and servicing of the connector.

It is not uncommon for connectors of this type to have 100, 200 or 250 electrical contacts mounted within the dielectric insert of both the plug and receptacle. When there is such a large number of contacts it is desirable, if not essential, that the mating force required between each pair of mating contacts be less than about 25 to 90 grams (1 to 3 ounces) so that the total force required to mate the plug to the receptacle is not beyond the capability of an individual. In addition to requiring low mating force contacts it is sometimes required that the mating contact pairs be capable of at least 5,000 matings with minimal detrimental effects, e.g., minimum wear and maintenance of the resiliency of the spring fingers of the socket contact.

Examples of socket contacts that are made by stamping and forming the contact from sheet metal may be found in U.S. Pat. No. 4,072,394 issued Feb. 7, 1978 and entitled "Electrical Contact Assembly" and U.S. Pat. No. 4,120,556 issued Oct. 17, 1978 and entitled "Electrical Contact Assembly." An example of a socket contact machined from a single piece of metal may be found in U.S. Pat. No. 3,286,222 issued Apr. 9, 1964 and entitled "Prestressed Electrical Contact" and finally, examples of socket type contacts made from a combination of a stamped and formed member and a machined body may be found in U.S. Pat. No. 3,023,396 issued June 13, 1957 and entitled "Socket Contact" and U.S. Pat. No. 3,564,487 issued Feb. 3, 1969 and entitled "Contact Member for Electrical Connector."

A socket contact that is machined from a solid piece of metal has the disadvantage that the resultant contact requires a high mating force of about 200 to 600 grams (7 to 21 ounces) and therefore such contacts are undesirable for use in connectors requiring more than 70 contacts within the plug or receptacle. Further, dimensions between contacts vary from machine to machine and day to day, making it difficult to obtain a consistent or fairly uniform mating force between mating contacts.

A socket contact that is made by stamping and forming the contact from sheet metal is undesirable in applications where a wire is soldered to one end of the contact because, during soldering, solder has a tendency to flow through the tubular contact to the mating portion of the contact.

Presently, contacts which utilize a machined body with a spring member attached thereto have the disadvantage of not being capable of providing a soldered type socket contact with the ability to mate 5,000 times or more with minimal detrimental effect either to the contact itself or to the mating pin type contact. This is particularly true in size 20 and larger electrical connectors which have contacts that are adapted to receive and be soldered to 20 gauge wire.

DISCLOSURE OF THE INVENTION

This invention provides a socket contact that is adapted to be soldered to a 20 gauge wire and is capable of 4,000 or 5,000 matings with minimal detrimental effects to the contact.

The contact is characterized by a machined contact body, a tubular spring member having at least one radially inwardly extending detent that engages a groove in the contact body to secure the spring member to the body and a sleeve telescopically mounted over the tubular spring member.

Accordingly, it is an advantage of this invention to provide a socket type electrical contact that mates with a pin type contact with a minimum amount of force.

It is another advantage of this invention to control the mating force associated with a socket contact by controlling the fit between its tubular spring member and its outer protective sleeve.

It is another advantage of this invention to provide an electrical connector having more than 200 mateable contacts that can be mated with a reasonable amount of force.

It is another advantage of this invention to provide a socket contact that minimizes the wear on a mating pin type contact.

It is another advantage of this invention to provide a multipiece socket contact assembly that is less costly to make than existing machined type contacts or three piece stamped and formed contacts.

DETAILED DESCRIPTION OF THE INVENTION

Figure 1:
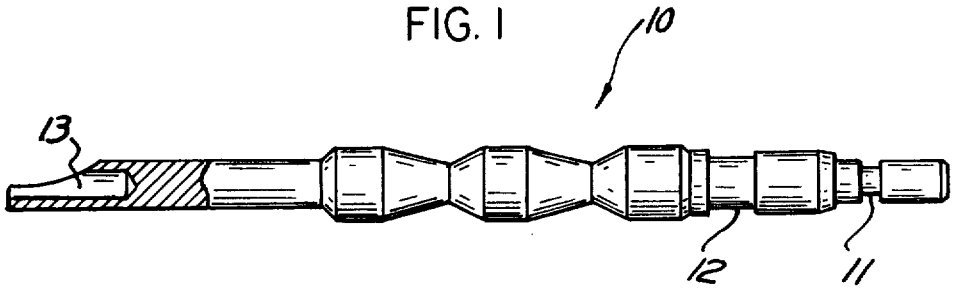
FIG. 1 illustrates a machined contact body.

Referring now to the drawings, FIG. 1 illustrates a solid contact body 10 that is machined from a single piece of stock such as brass. The rear portion of the contact body 10 includes a passage 13 for receiving a wire (not shown) which is then soldered to the body 10. The forward portion of the contact body 10 includes a first annular groove 11 and a second annular groove 12. The shape of the middle portion of the contact body 10 may take any configuration necessary to retain the contact body within an electrical connector insert.

Figure 2:
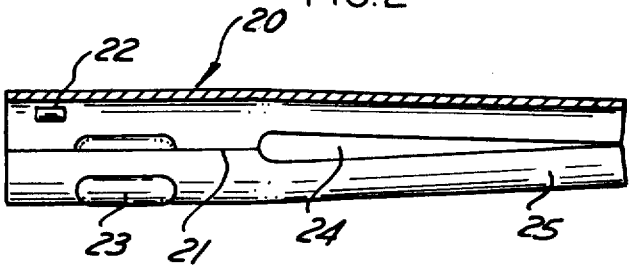
FIG. 2 illustrates a stamped and formed spring member.

FIG. 2 illustrates a tubular spring member 20 having a plurality of forwarding opening longitudinal slots 24, an axial seam or slit 21, at least one radially inwardly extending detent 22 or spring finger and a plurality of radially outwardly extending bosses 23. The bosses 23 may extend axially or helically along the surface of the spring member 20. The longitudinal slots 24 are pressed together at the open end to provide resiliently deflectable spring fingers 25 adapted to receive a pin type contact (not shown). The tubular spring member 20 is generally comprised of a material such as beryillum copper which has been heat treated and plated to provide the desired resiliency in the spring fingers 25. By increasing or decreasing the height of the bosses 23, the diameter and tightness between the spring member 20 and sleeve 30 may be controlled thereby controlling the mating force of the spring member 20 with a pin type contact.

Figure 3:
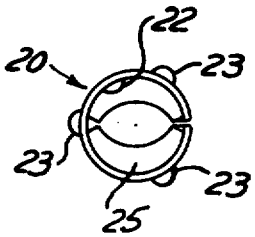
FIG. 3 illustrates an end view of the spring member shown in FIG. 2.

FIG. 3 is an end view of the tubular spring member 20 which illustrates the inwardly extending detent 22 and the outwardly bosses 22. If desirable the spring member 20 may have a plurality of detents 22 to increase its retention capability.

Figure 4:
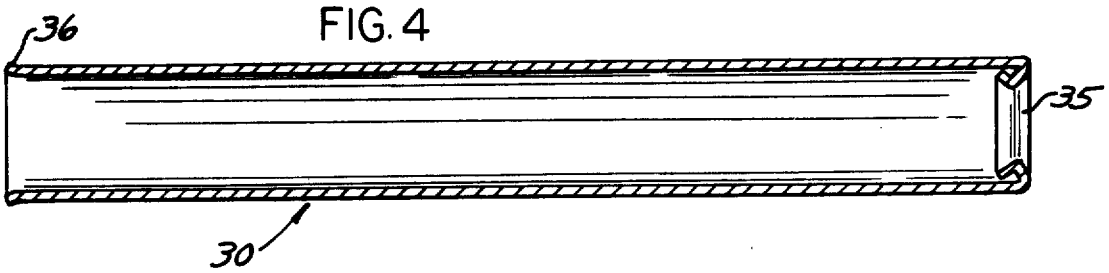
FIG. 4 illustrates a protective sleeve.

FIG. 4 illustrates a protective sleeve 30 which may be used to protect the spring fingers 25 of the tubular spring member 20 shown in FIG. 2. The protective sleeve 30 may be comprised of a material such as stainless steel and includes a forward end 35 which has been rolled inwardly to provide a means for guiding a pin type contact (not shown) into the sleeve 30. The opposite end 36 is slightly flared so that it may be placed over the contact body 10 shown in FIG. 1 where it may then be rolled into the second groove 12 in the contact body 10.

Figure 5:
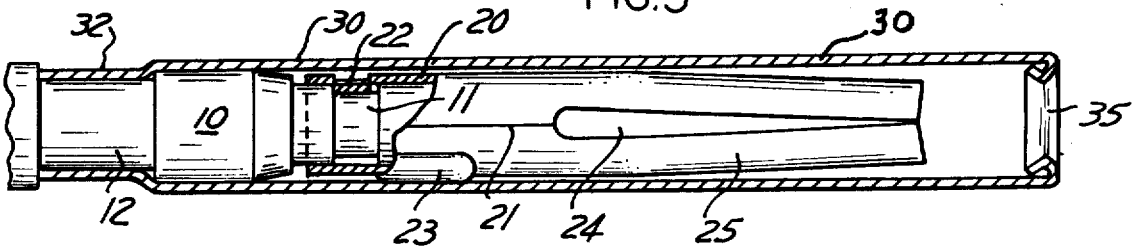
FIG. 5 illustrates a socket type contact assembly incorporating the principles of this invention.

FIG. 5 illustrates how the contact body 10, the tubular spring member 20 and the sleeve 30 are mounted together. The detent 21 in the spring member 20 secures the spring member 20 to the contact body 10. Protective sleeve 30 is mounted to the contact body 10 by forming one end position 32 of the sleeve 30 into the second groove 12 in the contact body. The outwardly extending bosses 23 on the spring member 20 are designed to come into pressure contact with the inner wall of the sleeve 30. This pressure in turn applies pressure to the radially inwardly extending detent 22 to secure the tubular spring member 20 to the contact body 10.

While a preferred embodiment of this invention has been disclosed, it will be apparent to those skilled in the art, that changes may be made to the invention as set forth in the appended claims, and in some instances certain features of the invention may be used to advantage without a corresponding use of other features. For instance, the protective sleeve 30 may or may not be used in combination with the contact body 10 and spring member 20. Also, there may be a plurality of detents 22 or, instead of detents, radially and inwardly extending spring fingers to engage the shoulders in the groove 11. Accordingly, it is intended that the illustrative and descriptive materials herein be used to illustrate the principles of the invention and not to limit the scope thereof.

Having described the invention what is claimed is:

1. A socket contact for an electrical connector comprising:

a solid contact body having a rear portion including means for receiving a wire, a forward portion having a first annular groove therein and a second annular groove rearwardly of said first groove;

a tubular spring member having an axial slit extending from the rear end to one of the forward end and a slot to allow circumferential compression of said member, said tubular member further including a forward end portion having a plurality of forwardly opening longitudinal slots extending rearwardly from the forward end of said spring to provide a plurality of forwardly extending spring fingers, a rear portion having means for engaging the first groove in said contact body whereby said spring member is secured to said body and a plurality of radially and outwardly extending bosses in the rear portion of said tubular spring member; and a sleeve telescopically mounted over said tubular spring member, said sleeve including means for engaging the second groove in said contact body whereby said sleeve is secured to said body said sleeve engaging in pressure tight relationship each of the bosses in the rear portion of said spring member.

2. The socket contact as recited in claim 1 wherein said spring member means for engaging the first groove in said contact body comprises at least one radially inwardly extending detent.

3. The socket contact as recited in claim 2 wherein said contact body includes a second annular groove rearwardly of said first groove, said tubular spring member includes an axial seam therein, and said socket contact further includes a sleeve having means for engaging the second groove in said contact body, said sleeve in pressure tight contact with the outwardly extending detents in said tubular spring member whereby each detent in said tubular spring member is pressed into the annular groove in said contact body.

4. The socket contact as recited in claim 1 wherein said bosses are helically arranged on the spring member.

* * * * *